United States Patent [19]

Meckl et al.

[11] Patent Number: 4,636,460

[45] Date of Patent: Jan. 13, 1987

[54] PHOTOGRAPHIC RECORDING MATERIAL AND PROCESS FOR THE PRODUCTION OF PHOTOGRAPHIC IMAGES

[75] Inventors: Heinz Meckl, Bergisch Gladbach; Helmut Kampfer, Cologne; Helmut Häseler, Leverkusen, all of Fed. Rep. of Germany

[73] Assignee: Agfa Gevaert Aktiengesellschaft, Leverkusen, Fed. Rep. of Germany

[21] Appl. No.: 743,634

[22] Filed: Jun. 11, 1985

[30] Foreign Application Priority Data

Jun. 20, 1984 [DE] Fed. Rep. of Germany ..... 3422917

[51] Int. Cl.[4] ..... G03C 5/24; G03C 1/06; G03C 1/48

[52] U.S. Cl. ..... 430/442; 430/566; 430/542; 430/377; 430/386; 430/550; 430/448; 430/599; 430/375

[58] Field of Search ..... 430/542, 543, 377, 386, 430/550, 442, 448, 599, 375, 566

[56] References Cited

U.S. PATENT DOCUMENTS

| | | | |
|---|---|---|---|
| 742,405 | 10/1903 | Eichengrün et al. | 430/566 |
| 3,212,895 | 10/1965 | Barbier et al. | 430/566 |
| 3,278,307 | 10/1966 | Stewart et al. | 430/566 |
| 3,415,651 | 12/1968 | von Konig et al. | 430/566 |
| 3,419,395 | 12/1968 | von Konig et al. | 430/566 |
| 4,390,617 | 6/1983 | Okaniwa et al. | 430/566 |

*Primary Examiner*—Won H. Louie

*Attorney, Agent, or Firm*—Connolly and Hutz

[57] ABSTRACT

Photographic recording materials which contain a developer substance or a precursor thereof produce better results if in addition they contain a sulphite, a disulphite or a compound capable of releasing sulphite in the photographic material.

3 Claims, No Drawings

PHOTOGRAPHIC RECORDING MATERIAL AND PROCESS FOR THE PRODUCTION OF PHOTOGRAPHIC IMAGES

This invention relates to a photographic recording material and to a process for the production of photographic images.

It is known to produce photographic images by exposure and development of a recording material containing silver halide. Development may be carried out by the action of heat on the recording material which contains suitable developer substances. DE-AS No. 1,159,758, for example, discloses a light-sensitive material for the heat copying process which may contain a developer substance of the p-phenylene diamine series. Small quantities of inorganic salts of sulphurous acid, for example, may be added to the silver halide emulsion.

Materials which are developed in an aqueous bath after image-wise exposure have become more widely used. The developer substance may in this case be contained in the recording material or in the developer bath. Colour photographic recording materials are customarily developed, after image-wise exposure, in an aqueous bath containing a colour developer substance, usually a p-phenylene diamine. Development is followed by bleaching and fixing, which may be combined.

It has been proposed to simplify processing by adding the developer substance to the recording material itself. The developer bath may in that case be replaced by an alkaline activating bath. The addition of p-phenylene diamines to recording materials, however, produces unsatisfactory results due to insufficient stability. Numerous proposals have been made for obtaining an improvement by using particular derivatives and precursor compounds. According to Reeves, U.S. Pat. No. 3,342,599, an improvement may be achieved by using precursor compounds in the form of Schiffs bases of p-phenylene diamines. According to Vetter, U.S. Pat. No. 3,705,035, it is advantageous to incorporate p-phenylene diamines which carry an alkyl group having from 8 to 20 carbon atoms on a nitrogen atom. According to Barr, U.S. Pat. No. 3,719,492, reaction products of polyvalent metal atoms and p-phenylene diamine serve to improve stability. Other methods and compounds are given in U.S. Pat. Nos. 4,297,441; 4,324,856 and 4,439,519 and European Applications 29 722; 74 763 and 80 896. Recording materials containing a developer substance and a polymer layer having a particular permeability are known from EP-A No. 74 763. These materials may also contain inhibitors and anti-oxidising agents, such as reductones, ascorbic acid and hydroxylamines.

The proposed measures, however, do not ensure the desired sensitivity to a satisfactory extent.

It was therefore an object of the present invention to provide improved materials and processes using incorporated developers or developer precursors.

A light-sensitive recording material for the production of photographic images by development in an aqueous bath has now been found, comprising at least one silver halide emulsion layer and optionally other layers and containing in at least one layer at least one developer compound or a salt or precursor compound thereof. According to the present invention, at least one layer of the material contains at least one sulphite, one disulphite or one compound releasing a sulphite under the conditions prevailing in the recording material.

The materials according to the present invention are developed in an aqueous bath after exposure. They differ in this respect, for example, from materials which are developed by heat or by means of a paste, as in the diffusion transfer process.

The present invention further relates to a process for the production of photographic images by developing, in an aqueous bath, a recording material which has been imagewise exposed, the material containing at least one silver halide emulsion layer and optionally other layers and containing at least one developer compound in at least one layer. The recording material used according to the present invention contains in at least one layer a sulphite or disulphite or a compound which releases a sulphite under the conditions prevailing in the recording material.

The developer substances may be black-and-white developer substances or precursors thereof; for example, p-aminophenols, pyrazolidones or hydroquinones.

According to a preferred embodiment, however, the present invention relates to colour photographic materials, in particular having incorporated couplers, which materials in addition contain a colour developer compound. Unless otherwise indicated, the term "colour developer compound" is used below to include not only the colour developer substance proper, but also a salt thereof or a precursor compound which is capable of releasing the colour developer substance under suitable conditions, in particular in an alkaline medium. p-phenylene diamines are particularly preferred colour developer compounds of this type, in particular those corresponding to the following general formula:

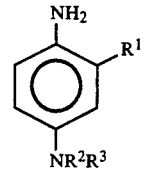

wherein $R^1$ represents hydrogen or a substituted or unsubstituted alkyl or alkoxy group, in particular one having from 1 to 4 carbon atoms., e.g. methyl, ethyl or methylsulphonamido alkyl;

$R^2$ represents a substituted or unsubstituted alkyl group, in particular having from 1 to 4 carbon atoms;

and $R^3$ represents a substituted or unsubstituted alkyl group, in particular having from 1 to 4 carbon atoms, which is preferably terminally substituted with a hydroxyl, methylsulphonamido or ω-sulphoalkyl group or an alkoxy group.

According to a preferred embodiment, the developer compound is present in the form of a salt, e.g. a hydrochloride, sulphate or phosphate, or a salt with an organic acid, e.g. a toluene sulphonate, tetraphenylboranate, alkyl benzene sulphonate, alkyl sulphonate, alkyl sulphate, alkyl aryl sulphate, alkyl phosphate or alkyl aryl phosphate.

The following are examples of suitable developer precursors:

1. Precursors of the type of Schiffs bases with aromatic aldehyde derivatives, which have been described, for example, in U.S. Pat. Nos. 3,342,599; 2,507,114 and 2,695,234 and in Research Disclosure No. 15159.

2. Complex compounds with metals, such as zinc, lead, or cadmium, which are known from U.S. Pat. No. 3,719,492.
3. Phthalimide derivatives known from British Pat. No. 803,783.
4. Phosphoric acid imide derivatives (Research Disclosure No. 12146).
5. Saccharic amine reaction products (Research Disclosure No. 13924).
6. Precursor compounds of the urethane type (Japanese unexamined Application No. 135 628/1978 and 79 035/1979).
7. Compounds of the hydroxamic acid type according to Ohhi, U.S. Pat. No. 4,439,519.
8. Precursors of the aminoalkyl/aryl sulphonic acid type or corresponding sulphonic or phosphonic acid derivatives (EP No. 29 722).

Certain developer substances and their salts and precursor compounds are shown in the following table:

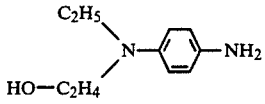
(1)

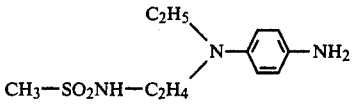
(2)

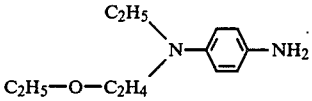
(3)

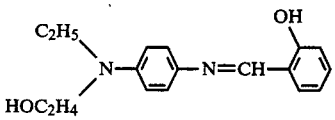
(4)

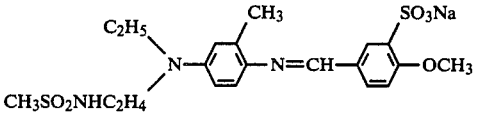
(5)

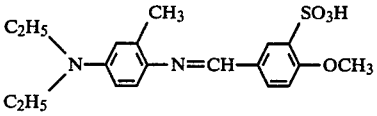
(6)

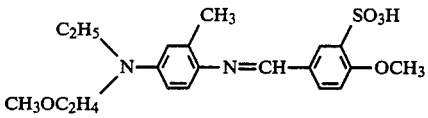
(7)

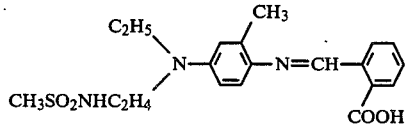
(8)

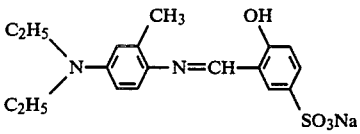
(9)

-continued

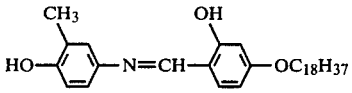
(10)

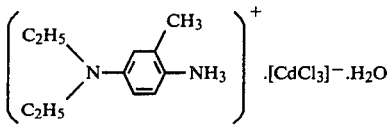
(11)

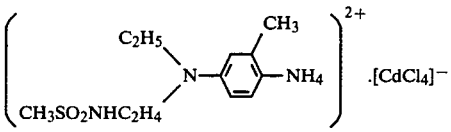
(12)

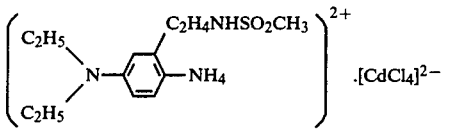
(13)

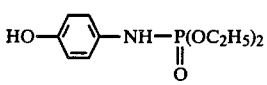
(14)

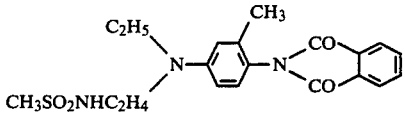
(15)

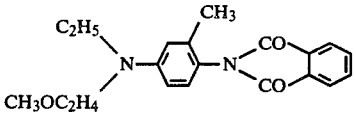
(16)

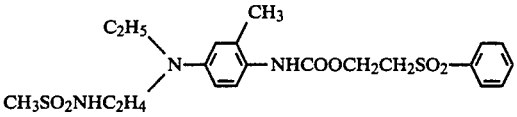
(17)

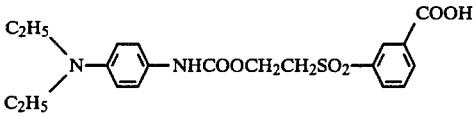
(18)

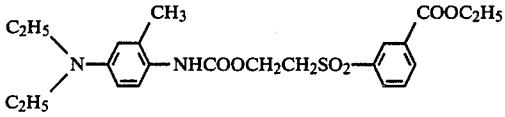
(19)

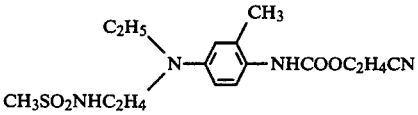
(20)

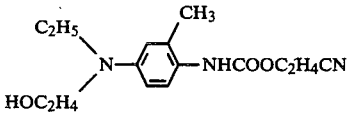
(21)

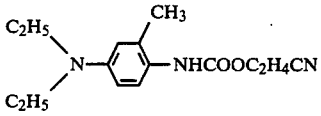
(22)

-continued (23)

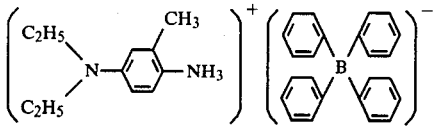

(24)

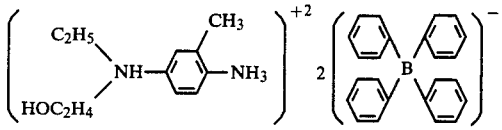

(25)

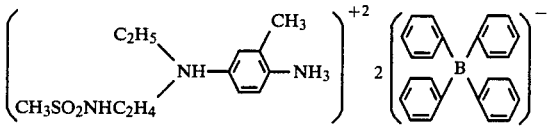

(26)

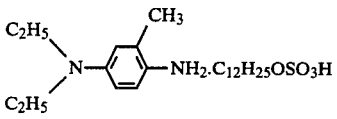

(27)

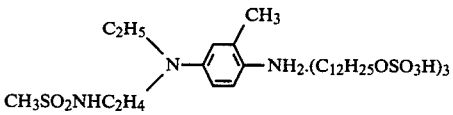

(28)

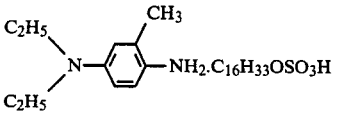

(29)

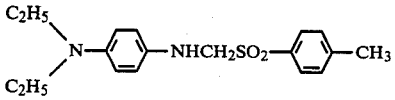

(30)

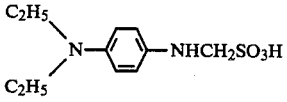

(31)

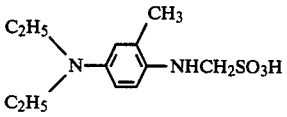

(32)

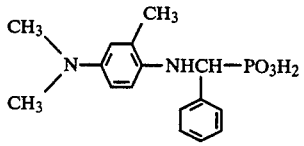

(33)

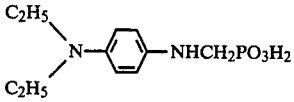

(34)

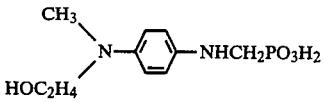

-continued (35)

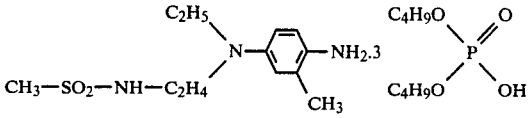

(36)

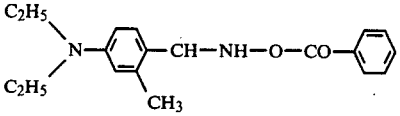

The developer compounds, including salts and precursor compounds thereof, are preferably introduced into the recording material in a quantity of from 0.01 to 1, more preferably from 0.1 to 0.3, mol per mol of silver halide to be developed. The developer substance may be added in aqueous solution or as a dispersion. It may be introduced into silver halide emulsion layers or adjacent to the silver halide emulsion layers. The developer substance may also be accommodated at the back of the layer support.

The sulphite to be used according to the present invention is preferably accomoodated in the same layer as the developer compound, but may in some cases be added to an adjacent layer. The sulphite is preferably added in a quantity of from 0.01 to 1 mol, more preferably from 0.04 to 0.2 mol, of sulphite per mol of developer compound. Alkali metal disulphites are particularly suitable sulphites.

The sulphite may also be added in the form of precursor compounds from which it may be released under the conditions prevailing in the recording material. The following are examples of suitable precursor compounds of this type:

(1) addition products with aldehydes and ketones, e.g. with formaldehyde to form formaldehyde bisulphite;
(2) with cyclohexanone to form cyclohexanone bisulphite;
(3) with pentaerythritol to form pentaerythritol sulphite.

The exposed recording material is introduced into an aqueous alkaline bath for development. This bath may in addition contain a colour developer compound. According to a preferred embodiment, however, this bath contains relatively little or no developer substance, in which case the bath is an alkaline activator bath into which certain compounds may be introduced, e.g. to prevent oxidation, such as hydroxylamine, ascorbic acid, certain sugars and glucosamine, complex-formers, the conventional buffer compounds, development accelerators, anti-fogging agents, competing couplers, surface active agents and optical brightening agents. See in this connection Ullmans Enzyklopädie der technischen Chemie, 4th Edition, Volume 18, 1979, in particular pages 451,452 and 463 to 465. A detailed description of suitable developer compositions and methods of processing is given by Grant Haist, Modern Photographic Processing, John Wiley and Sons, 1973, Volumes 1 and 2. A pH of from 9.5 to 13 is generally chosen for the developer or activator bath.

When the material according to the present invention is used, the developer or activator bath may be regenerated without overflow. "Without overflow" means that the quantity of regenerating substance required for maintaining a constant developer activity exactly compensates for the volume of liquid carried out of the developer tank by the photographic material.

Development may be followed in the conventional manner by bleaching and fixing or a combination of the two. The conventional bleaching agents may be used. Among these may be included compounds of polyvalent metals, such as iron(III), cobalt(III), chromium(VI) and copper(II) and the like, and peracids, quinones, nitroso compounds and the like. Salts and complexes of trivalent iron and persulphates are particularly suitable. Examples of suitable iron-III-complexes include complexes with aminopolycarboxylic acids, e.g. ethylene diaminotetraacetic acid, nitrilotriacetic acid and 1,3-diamino-2-propanol-tetraacetic acid, and hexacyanoferrates. The baths to be used according to the present invention may contain the other conventional constituents of bleaching baths.

Fixing may be carried out using the conventional fixing baths which contain a silver halide solvent as the main constituent thereof. Thiosulphates are particularly preferred. The fixing baths may also contain sulphites, borates and other conventional additives.

The light-sensitive silver halide emulsion layers having colour couplers associated therewith which react with colour developer oxidation products to form a non-diffusible dye. The colour couplers are advantageously accommodated in a non-diffusible form in the light-sensitive layer itself or closely adjacent thereto.

Thus, the red-sensitive layer, for example, may contain a non-diffusible colour coupler to produce the cyan partial colour image, generally a coupler of the phenol or α-naphthol series. The green-sensitive layer may contain, for example, at least one non-diffusible colour coupler to produce the magenta partial colour image, generally a colour coupler of the 5-pyrazolone series. The blue-sensitive layer may contain, for example, at least one non-diffusible colour coupler to produce the yellow partial colour image, generally a colour coupler having an open-chain ketomethylene group. The colour couplers may be, for example, 6-, 4- or 2-equivalent couplers. Suitable couplers are known, for example, from the publications "Farbkuppler" by W. Pelz in "Mitteilungen aus den Forschungslaboratorien den Agfa, Leverkusen/Müchen", Volume III, page 111 (1961); K. Venkataraman in "The Chemistry of Synthetic Dyes", Volume 4, 341 to 387, Academic Press (1971); and T. H. James, "The Theory of the Photographic Process", 4th Edition, pages 353–362, and Research disclosure No. 17643 of December 1978, section VII, published by Industrial Opportunities Ltd., Homewell Havent, Hampshire, PO9 1EF, Great Britain.

The recording material may also contain DIR compounds and so-called "white" couplers which do not produce a dye in reaction with colour developer oxidation products. By DIR "compounds" are meant compounds which react with colour developer oxidation products to release diffusible organic compounds which inhibit the development of silver halide. These inhibitors may be split off directly or by way of non-inhibitory intermediate compounds. See GB No. 953,454, U.S. Pat. No. 3,632,345, U.S. Pat. No. 4,248,962 and GB No. 2,072,363.

The halides contained in the light-sensitive silver halide emulsions may be chlorides, bromides, iodides or mixtures thereof. According to a preferred embodiment, the halide portion of at least one layer is composed of from 0 to 10 mol % of AgI, from 0 to 50 mol & of AgCl and from 50 to 100% of AgBr, the sum of these proportions adding up to 100%. According to another preferred embodiment, the halide of at least one silver halide emulsion consists predominantly of chloride. The silver halide grains may in principle have a layered grain structure composed of a core and at least one shell.

The emulsions may be chemically sensitized. The conventional sensitizing agents are suitable for chemically sensitizing the silver halide grains. Compounds containing sulphur are particularly preferred, e.g. allyl isothiocyanate, allylthiourea and thiosulphates. Reducing agents may also be used as chemical sensitizers, e.g., the tin compounds described in Belgian Pat. Nos. 493,464 or 568,687; also polyamines, such as diethylene triamine, or aminomethyl sulphinic acid derivatives, e.g. according to Belgian Pat. No. 547,323. Noble metals, such as gold, platinum, palladium, iridium, ruthenium or rhodium, and compounds thereof are also suitable chemical sensitizers. This method of chemical sensitization has been described in the article by R. Koslowsky, Z. Wiss. Phot. 46, 65–72 (1951). The emulsions may also be sensitized with polyalkylene oxide derivatives, e.g. with a polyethylene oxide having a molecular weight of from 1,000 to 20,000, or with condensation products of alkylene oxides and aliphatic alcohols, glycols, cyclic dehydration products of hexitols, with alkyl substituted phenols, aliphatic carboxylic acids, aliphatic amines, aliphatic diamines and amides. These sensitizers may, of course, be combined to produce specialised effects, as described in Belgian Pat. No. 537,278 and British Pat. No. 727,982. See also the above-mentioned Research Disclosure No. 17 643, Section III.

The emulsions may be optically sensitized in known manner, e.g. with the conventional polymethine dyes, such as neutrocyanines, basic or acid carbocyanines, rhodacyanines, hemicyanines, styryl dyes, oxonols and the like. Stabilizers of this type have been described by F. M. Hamer in "The Cyanine Dyes and related Compounds", (1964). See in this respect also in particular Ullmanns Enzyklopädie der technischen Chemie, 4th Edition, Volume 18, pages 431 et seq and the above-mentioned Research Disclosure No. 17643, Section IV.

The conventional anti-fogging agents and stabilizers may be used. Azaindenes are particularly suitable stabilizers, especially tetra- and penta-azaindenes, in particular those which are substituted with hydroxyl or amino groups. Compounds of this type are described, for example, in the article by Birr, Z. Wiss. Phot. 47, 1952, pages 2–58. Other suitable stabilizers and anti-fogging agents are indicated in the above-mentioned Research Disclosure No. 17643, Section IV.

The constituents of the photographic material may be incorporated by the conventional methods. If the compounds are soluble in water or alkalies, they may be incorporated in the form of aqueous solutions, optionally with the addition of water-miscible organic solvents, such as ethanol, acetone or dimethyl formamide. If they are insoluble in water or alkalies, they may be incorporated in the recording materials in the form of dispersions in known manner. See in this connection, for example, U.S. Pat. Nos. 2,322,027; 2,533,514; 3,689,271; 3,764,336 and 3,765,897. Certain constituents of the photographic material, e.g. couplers and UV absorbents, may also be incorporated in the form of charged latices, see DE-OS No. 2,541,274 and EP-A No. 14921. The constituents may also be fixed in the material as polymers, see e.g. DE-OS No. 2,044,992, U.S. Pat. No. 3,370,952 and U.S. Pat. No. 4,080,211.

The conventional layer supports may be used for the materials according to the present invention, e.g. supports of cellulose esters, such as cellulose acetate, and of polyesters. Paper supports are also suitable and may be coated, e.g. with polyolefins, in particular with polyethylene or polypropylene. See in this connection the above-mentioned Research Disclosure No. 17643, Section XVII.

The conventional hydrophilic film-forming substances may be used as protective colloids or binders for the layers of the recording material, e.g. proteins, in particular gelatine, alginic acid or derivatives thereof, such as esters, amides or salts, cellulose derivatives, such as carboxymethyl cellulose or cellulose sulphates, starch or derivatives thereof or hydrophilic synthetic binders, such as polyvinyl alcohol, partially saponified polyvinyl acetate, polyvinyl pyrrolidone, etc. The hydrophilic binders in the layers may also be mixed with other synthetic binders in the form of solutions or dispersions, such as homo- or co-polymers of acrylic or methacrylic acid or derivatives thereof, such as esters, amides or nitriles, or vinyl polymers, such as vinyl esters or vinyl ethers. See also the binders indicated in the above-mentioned Research Disclosure 17643, in Section IX.

The layers of the photographic material may be hardened in the conventional manner, for example with hardeners of the epoxide type, the heterocyclic ethylene imine or the acryloyl type. The layers may also be hardened by the process according to German Offenlegungsschrift No. 2,218,009 to produce colour photographic materials which are suitable for high temperature processing. The photographic layers or colour photographic multilayered materials may also be hardened with hardeners of the diazine, triazine or 1,2-dihydroquinoline series or with vinyl sulphone type hardeners. Other suitable hardeners are known from German Offenlegungsschrift Nos. 2,439,551; 2,225,230 and 2,317,672 and the above-mentioned Research Disclosure 17643, Section XI.

EXAMPLE 1

A layer support of paper coated with polyethylene on both sides was provided with the following layers. The quantities given relate to 1 $m^2$.

1. A gelatine layer.
2. A green-sensitive silver chlorobromide emulsion layer (20 mol % chloride) containing 385 mg of magenta coupler corresponding to the following formula:

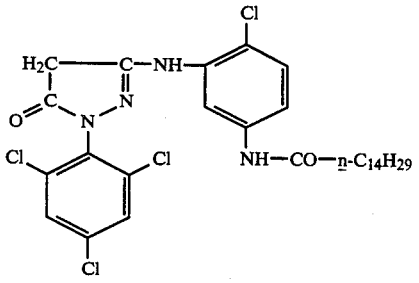

in dibutyl phthalate. Silver application corresponding to 550 mg $AgNO_3$

3. A gelatine protective layer.
4. A gelatine layer treated with an instant hardener.

The following samples were prepared by incorporation in layer 1:

| Sample | Developer Compound | Sulphite compound |
|---|---|---|
| 1 | 0.9 g No. 35 | — |
| 2 | 0.9 g No. 35 | 0.1 g $K_2S_2O_5$ |
| 3 | 0.9 g No. 35 | 0.2 g formaldehyde bisulphite |
| 4 | 0.9 g No. 35 | 0.4 g cyclohexanone bisulphite |
| 5 | 0.9 g No. 35 | 0.4 g pentaerythritol sulphite |

The quantities are given per $m^2$.

The samples were image-wise exposed under a stepped wedge and processed by the following developer process.

| | |
|---|---|
| Development process at 33° | |
| 3.5 min. developer | |
| 1.5 min. bleach fixing bath | |
| 3.5 min. washing. | |
| Developer bath: | |
| water | 900 ml |
| benzyl alcohol | 14 ml |
| hydroxyl ammonium sulphate | 3 g |
| diethylene triamino-pentaacetic acid | 1.5 g |
| 4-amino-N—ethyl-N—(β-methane sulphonoamido)-m-toluidine-sesquisulphate (monohydrate) | 5 g |
| sodium sulphite | 1 g |
| potassium bromide | 0.6 g |
| potassium carbonate solution 40% | 55 ml |
| made up with water to 1 liter | |
| pH = 10.2 | |
| Bleach fixing bath | |
| water | 800 ml |
| sodium sulphite | 20 g |
| ammonium thiosulphate | 100 g |
| sodium-iron-ethylene diamino-tetraacetic acid | 45 g |
| potassium carbonate | 9 g |
| made up with water to 1 liter | |
| pH = 7.0 | |

| | Samples | | | | |
|---|---|---|---|---|---|
| | 1 (comparison) | 2 | 3 | 4 | 5 |
| Sensitivity at density 1.0 | 0.94 | 0.34 | 0.38 | 0.65 | 0.41 |

The lower the figures, the higher the sensitivity. A reduction by 0.3 corresponds to a doubling of the sensitivity.

The use of sulphite compounds or corresponding precursor compounds thus results in a surprising improvement in the sensitivity.

EXAMPLE 2

Variations 1 and 2 of the layer arrangements in Example 1 were exposed as indicated there and subjected to the following process:

| | |
|---|---|
| Activating process at 33° | |
| 2 min. activator | |
| 1 min. short stop bath | |
| 1.5 min. bleach fixing bath (composition as Example 1) | |
| 3.5 min. washing. | |
| Activator bath: | 1 liter |
| benzyl alcohol | 14 ml |
| hydroxylamine sulphate | 2 g |

-continued

| | |
|---|---|
| sodium sulphite | 2 g |
| potassium bromide | 0.5 g |
| nitrilotriacetic acid $Na_3$ salt | 2 g |
| sodiumhydroxide | 10 g |
| Short stop bath: | 2% acetic acid |

The following table demonstrates the sensitivity enhancing effect of the sulphite.

| | Samples | |
|---|---|---|
| | 1 (comparison) | 2 |
| Sensitivity at density 0.1 | 1.91 | 1.24 |

The sensitivity is defined as in Example 1.

We claim:

1. Light-sensitive photographic recording material for the production of photographic images by development in an aqueous bath, which material contains at least one silver halide layer and contains a color developer compound of the formula

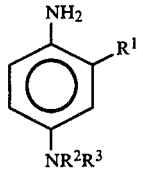

wherein $R^1$ represents hydrogen or $C_1$–$C_4$ alkyl $C_1$ to $C_4$ alkoxy or methylsulfonamido $C_1$ to $C_4$ alkyl group;

$R^2$ represents a $C_1$–$C_4$ alkyl group; and $R^3$ represents a $C_1$ to $C_4$ alkyl group unsubstituted or terminally substituted with a hydroxyl, methylsulfonamido or methoxy group or a salt thereof in at least one layer, characterised in that an alkali metal disulphite is contained in at least one layer.

2. Light-sensitive recording material according to claim 1, characterised in that the developer compound is a compound corresponding to the following formula or a salt or a precursor compound thereof:

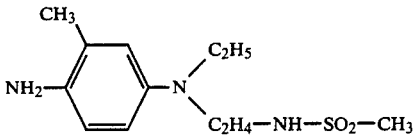

3. Process for the production of photographic images by the development, in an aqueous bath, of a recording material which has been image-wise exposed, which material contains at least one silver halide layer and contains a developer compound of the formula

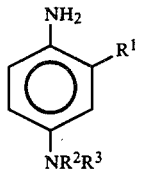

wherein $R^1$ represents hydrogen or $C_1$–$C_4$ alkyl, $C_1$ to $C_4$ alkoxy, or methylsulfonamido, $C_1$ to $C_4$ alkyl group:

$R^2$ represents a $C_1$–$C_4$ alkyl group; and $R^3$ represents a $C_1$ to $C_4$ alkyl group unsubstituted or terminally substituted with a hydroxyl, methylsulfonamido or methoxy group or a salt thereof in at least one layer, characterised in that the material contains, in at least one layer an alkali metal disulphite.

* * * * *